US005988998A

United States Patent [19]

Glover

[11] Patent Number: 5,988,998

[45] Date of Patent: Nov. 23, 1999

[54] ROTARY PUMP HAVING A REINFORCED FLEXIBLE ANNULAR DIAPHRAGM

[75] Inventor: Brian Howard Glover, Camberley, United Kingdom

[73] Assignee: Charles Austin Pumps Ltd., Surrey, United Kingdom

[21] Appl. No.: 08/893,275

[22] Filed: Jul. 15, 1997

[30] Foreign Application Priority Data

Jul. 15, 1996 [GB] United Kingdom ..... 9614866

[51] Int. Cl.[6] ..... F04C 5/00; F04C 11/00

[52] U.S. Cl. ..... 418/45; 418/56; 418/66; 418/153; 418/215

[58] Field of Search ..... 418/45, 56, 66, 418/153, 154, 215; 417/476

[56] References Cited

U.S. PATENT DOCUMENTS

| | | | |
|---|---|---|---|
| 2,428,619 | 10/1947 | Douglas | 418/45 |
| 2,578,798 | 12/1951 | Gordinier | 418/56 |
| 2,583,572 | 1/1952 | Huber | 418/56 |
| 5,006,049 | 4/1991 | von der Heyde | 417/476 |

FOREIGN PATENT DOCUMENTS

| | | | |
|---|---|---|---|
| 916780 | 4/1982 | Russian Federation | 417/476 |
| 583578 | 11/1945 | United Kingdom . | |
| 785597 | 10/1957 | United Kingdom | 418/45 |
| 1244054 | 8/1971 | United Kingdom . | |
| 1280185 | 7/1972 | United Kingdom . | |
| 2037371 | 7/1980 | United Kingdom . | |

*Primary Examiner*—John J. Vrablik
*Attorney, Agent, or Firm*—Kenyon & Kenyon

[57] ABSTRACT

A rotary diaphragm fluid pump includes a rigid tubular body with internal annular groove, a tubular flexible diaphragm whose central portion is caused to orbit by an eccentrically driven bearing. Preferably the diaphragm is a moulding which features an elastic fixed abutment between the inlet and outlet ports, and internal reinforcement to ensure that the full diaphragm stroke is achieved. Two such pumps may compliment each other to produce a pulsation free output.

8 Claims, 2 Drawing Sheets

ROTARY PUMP HAVING A REINFORCED FLEXIBLE ANNULAR DIAPHRAGM

BACKGROUND OF THE INVENTION

1. Field of the Invention

This invention relates to rotary diaphragm positive displacement pumps.

2. Background Prior Art

A typical rotary diaphragm pump consists of a rigid tubular housing with an annular channel running around the inner surface, which acts as the pumping chamber, and a flexible tubular diaphragm which is caused to orbit eccentrically in the channel thereby sweeping the fluid in its path from the inlet port to the outlet port. These ports are usually separated by some form of active partition which can form part of the diaphragm moulding and which is caused to be elastic by one of a number of different means.

This type of pump has a wide range of fluid pumping applications. The main benefits are that it does not rely on close fitting sliding components to develop a useful pressure and does not require shaft seals or valves, all of which are subject to wear and can cause pump failures.

Existing rotary diaphragm pump designs aim to provide higher pressures and operating speeds and lower levels of friction and wear but this in turn has led to an increase in problems associated with a pulsating input and output such as cavitation, water hammer and general noise. Pulsations can damage delicate fluids such as carbonated beverages and can cause over-rapid operation of pressure sensitive switches, plunger bounce in solenoid valves, and other system problems.

Existing designs also suffer from a lack of support for the diaphragm where it is at its furthest point from the housing wall. This renders the diaphragm vulnerable to early failure.

SUMMARY OF THE INVENTION

An object of this invention is to provide a rotary diaphragm pump which has a substantially sinusoidal output wave. Two such pumps arranged to operate exactly out of phase with another provide a smooth vacuum, pressure or flow characteristic. This stems from the addition of two out of phase sine waves resulting in a straight line. In the same way, two identical but opposed undistorted sinusoidal pump outputs produce a totally smooth output.

In practice, however, previous rotary diaphragm pump designs have settled for adding two or more non-sinusoidal outputs together with results ranging from an improvement, to making the output even less smooth in some circumstances.

In order for a rotary pump to generate a sinusoidal output wave with minimum distortion, several conditions must be met by the design.

The number of internal leak paths must be kept to a minimum. Rotary pumps which rely on close fits between sliding components are usually not capable of sealing well enough unless sufficiently viscose fluids are being pumped. Rotary diaphragm pumps, however, have fewer leak paths and provide a good basis for a smooth double acting pump.

The rotary diaphragm must be fixed rigidly to the eccentrically driven piston so that the two parts are always held concentric with each other and no movement can take place between them. Any movement here represents a loss of stroke and a source of friction. Previous designs which show a separate piston rolling around the inside of the diaphragm cannot maintain the necessary controlled and progressive volume displacement throughout the pumping cycle, since, to some extent, the diaphragm is free to move independently of the piston when under load.

This invention features a piston in the form of a rigid reinforcing ring which is moulded into, and is part of, the diaphragm, thereby providing full radial control over diaphragm movement and eliminating its elastic behaviour in the central region while causing all necessary flexing to be confined to the edges of the diaphragm. This has the effect of making the diaphragm movement both predictable and consistent over a wide range of pressure and vacuum loads and opens the way to a substantially sinusoidal wave, higher vacuum performance and less contact between moving and stationary parts.

In addition, a wide band in the centre of the cross-section of the diaphragm must be kept flat to prevent it from bowing under pressure and vacuum loads. Failure to achieve this causes excessive convex and concave ballooning of the greater part of the diaphragm which, in turn, causes too little fluid to be drawn in on the suction side (per degree of revolution), and too much fluid to accumulate on the pressure side until late in the cycle. This delay in the volume displacement causes a distortion of the sine wave and consequently the output wave. The width of the reinforcing ring in this invention determines how much of the diaphragm is allowed to flex, thereby limiting the ballooning effect due to both pressure and vacuum loads.

The use of fabric reinforcement in the diaphragm referred to in previous patents does not solve the bowing problem since it cannot provide enough tension to prevent it and at the same time allow sufficient flexibility for the pump to operate satisfactorily. In this invention, the areas of the diaphragm which are required to be flexible are clearly separated from those which are required to be rigid and this is achieved by the moulded in reinforcing ring.

The known idea of locally bonding the diaphragm to a piston, in order to provide improved vacuum performance does not solve this problem since any form of external support fails to provide either a rigid band in the centre of the elastomer or symmetrical support between pressure and vacuum loads. It also concentrates high tensile and shear loads on the edges of the bonded joint which increase as the width of the joint increases making this approach impractical. On the pressure side, the diaphragm is progressively supported more and more, whereas the vacuum side remains unsupported except for the highly stressed bonded joint.

This invention provides a rotary pump having a housing defining an annular chamber with inlet and outlet ports spaced apart around the chamber, a flexible annular diaphragm forming one side of the chamber spaced opposite an annular wall on the housing, the diaphragm being sealed at its edges to the housing, a partition extending across the chamber from a location between the inlet and outlet ports to the diaphragm and means to travel around the diaphragm pressing the diaphragm against the opposite wall of the housing to force fluid drawn in at the inlet around the chamber and to expel it at the outlet, and means to reinforce a central region around the annular diaphragm to hold the region substantially rigid thereby controlling the diaphragm sufficiently to provide a substantially sinusoidal displacement.

The moulding in of a reinforcing ring copes with the loads associated with high levels of diaphragm control and achievable vacuums in the order of 99%. Moulding the ring into the diaphragm also eliminates or minimises any friction, wear and energy loss between the two and also balances the pressure and suction cycles within the pump.

A further requirement for a substantially sinusoidal waveform is that the inlet and outlet ports should be as close together as possible so that the inlet port is effectively covered by the passing diaphragm before the outlet port opens thereby minimising back flow.

The arrangement of the invention also provides support to the flexing edges of the diaphragm, particularly at the beginning of the cycle when the whole diaphragm is subjected to high pressure loads.

As the flexible edges of a rotary diaphragm are fixed to the housing and the piston, it follows that it is not possible to provide it with solid support as it moves since it is constantly changing shape.

A further subsidiary object is to provides improved support to protect the diaphragm from pressure damage.

Previous arrangements provide support on the piston only, which leaves a large undesirable extrusion gap on the opposite side of the chamber where the diaphragm is allowed to balloon in the large gap between the housing and the piston. This invention limits this effect by means of static backing rings which provide a hard stop, reducing the chances of the diaphragm bursting through the gap. As the cycle progresses, diaphragm support is gradually transferred from the backing rings to the reinforcing ring and back again.

The ability of the reinforcing ring to maintain some contact between the diaphragm and the channel in the housing, determines the ultimate pressure which the pump can develop. In this invention, excessive output pressures will force the unsupported areas of the diaphragm away from the housing, thereby allowing a temporary leak back through the pump without causing damage. It follows therefore, that by adjusting the width of the reinforcing ring, it is possible to set the maximum pressure to a level which is safe for both the pump and the application without the use of any extra components Accordingly, this invention achieves rigid control over diaphragm movement to give the advantages of a rotary diaphragm pump with substantially smooth flow and enhanced diaphragm life.

BRIEF DESCRIPTION OF THE DRAWINGS

The following is a description of some specific embodiments of the invention, reference being made to the accompanying drawing in which.

DESCRIPTION OF THE PREFERRED EMBODIMENTS

Figure 1:
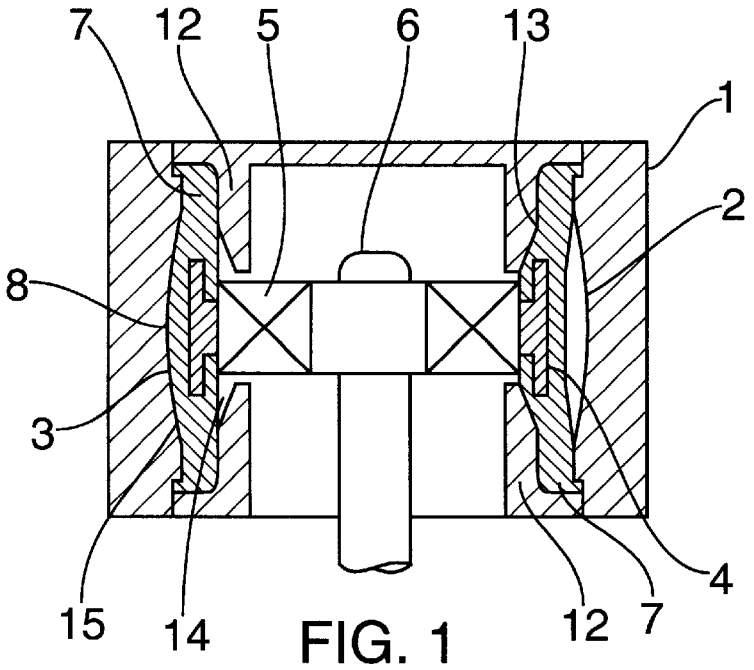
FIG. 1 shows a pump section along the axis of the drive shaft.

As shown in FIG. 1, a tubular part of a rigid housing 1 has an annular groove 2 running around the inner surface, which acts as the pump chamber. In its relaxed state, a flexible diaphragm moulding 3 lies inside the wall of the housing leaving the groove free to contain the pumped fluid. A rigid reinforcing ring 4 is moulded into the diaphragm and this serves to keep the central portion of the diaphragm in intimate contact at all times with an outer surface of a bearing 5 mounted eccentrically on a shaft 6 which extends through and is mounted in the housing in bearings (not shown). The shaft 6 is mounted concentrically with the annular groove and is powered by a motor (not shown). If the reinforcing ring were not present, the diaphragm would stretch and the performance would be reduced in a similar way to that experienced with peristaltic pumps, when the tubing collapses under vacuum.

As the drive shaft 5 rotatez, the bearing, reinforcing ring and central portion of the diaphragm all orbit together inside the housing. The two ends of the diaphragm tube 7 are clamped to the housing by the backing rings 12, providing an effective and static seal to atmosphere. As the central portion of the diaphragm orbits round inside the groove 2, line contact 8 exists between the diaphragm and the groove providing an abutment which pushes the fluid along towards the outlet port 9 and simultaneously draws fluid in through the inlet port 10. The pump thus provides pressure and suction cycles at the output and intake respectively which are symmetrical and which vary sinusoidally. Since the diaphragm does not rotate relative to the housing, there is minimal sliding action between them and therefore almost no wear.

Figure 2:
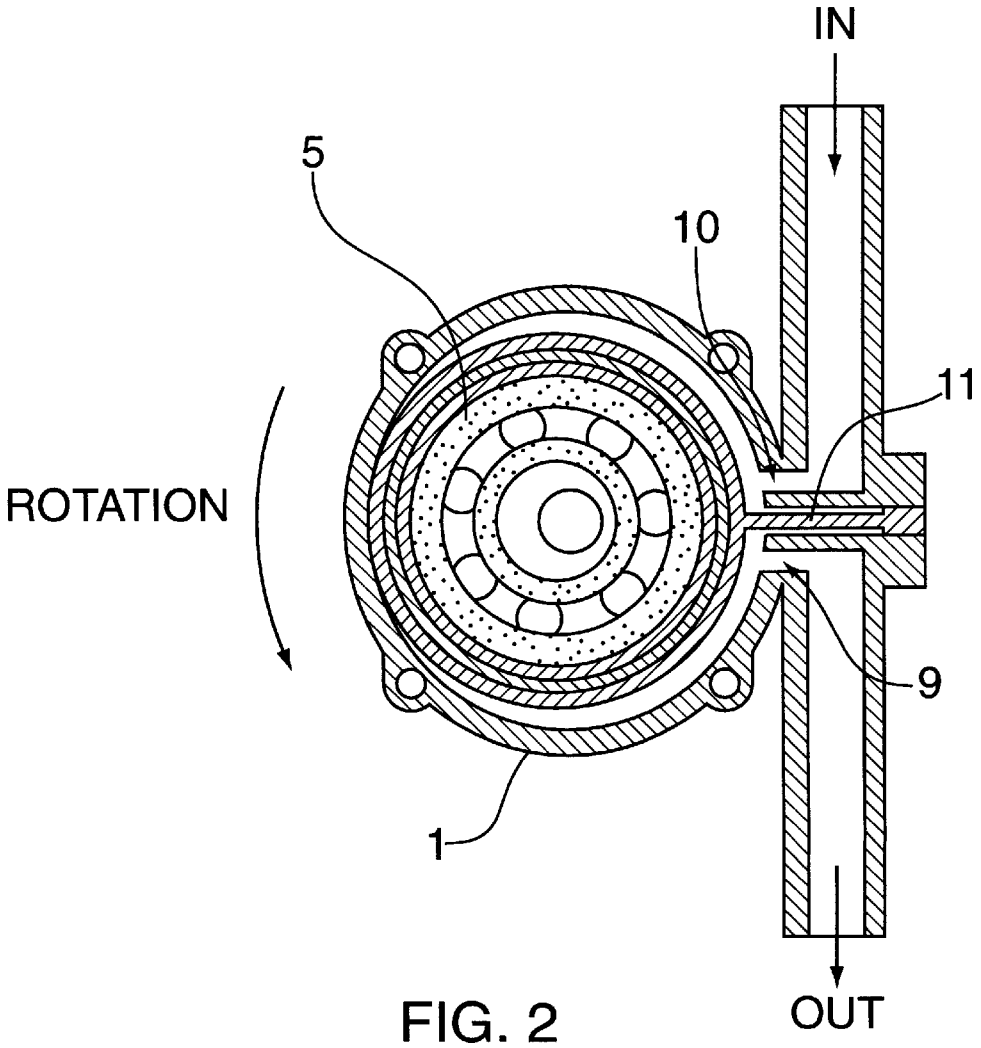
FIG. 2 shows a pump section across the axis of the drive shaft.
Figure 3:
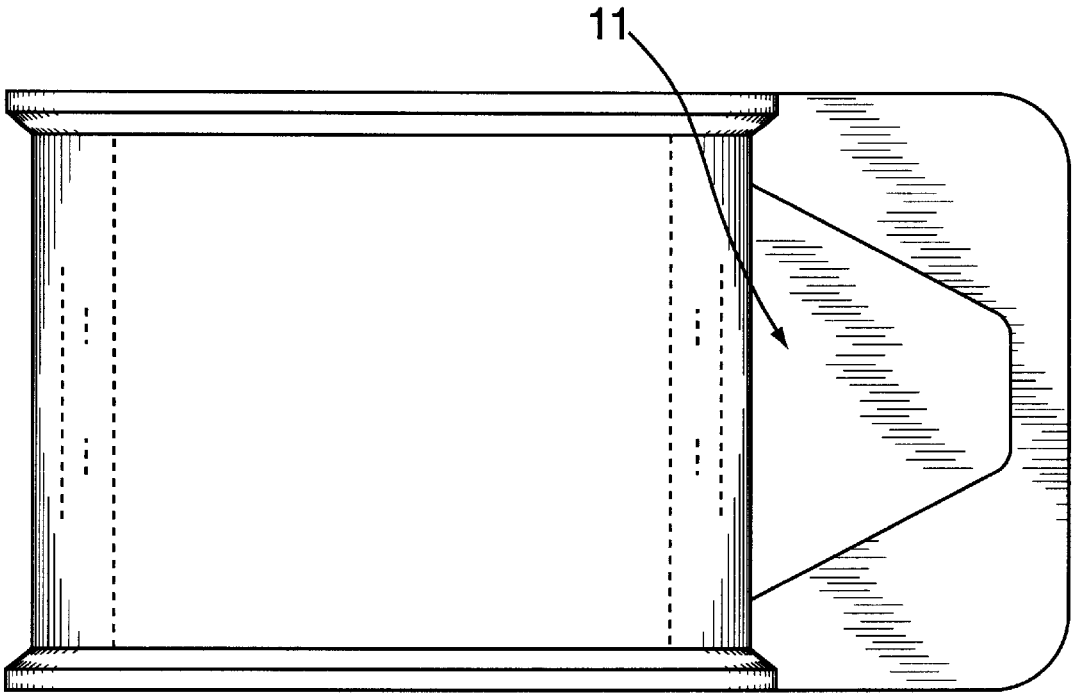
FIG. 3 shows a side view of the diaphragm moulding.

From FIGS. 2 and 3, it can be seen that another feature of the diaphragm moulding is an elastic abutment 11 which prevents communication between the outlet and inlet ports 9 and 10. Since it is elastic, it accommodates the reciprocating movement of the diaphragm tube whilst maintaining a static pressure seal between both ports and atmosphere. In this way, all compliant sealing functions required by the pump are provided by the diaphragm moulding and since none of these are sliding seals, they are not subject to significant wear.

As the diaphragm is necessarily made from an elastic material, it follows that a high output pressure would tend to inflate and distort it. This is a common problem with rotary diaphragm pumps, where the diaphragm is supported fully by the piston as it makes contact with the groove in the wall of the housing but is left mainly unsupported on the opposite side even though high pressure may still be present there. The backing rings 12 support the diaphragm at the limit of its travel and reduce the size of the extrusion gap throughout the cycle thereby enhancing diaphragm life. Such a solution is not possible with the usual wide piston approach to diaphragm support.

In the event that excessively high pressures are developed by the pump, in the above arrangement, the flexible edges of the diaphragm can be found away from the groove in the wall of the housing thereby causing a temporary internal bypass leak which reduces the high pressure.

Figure 4:
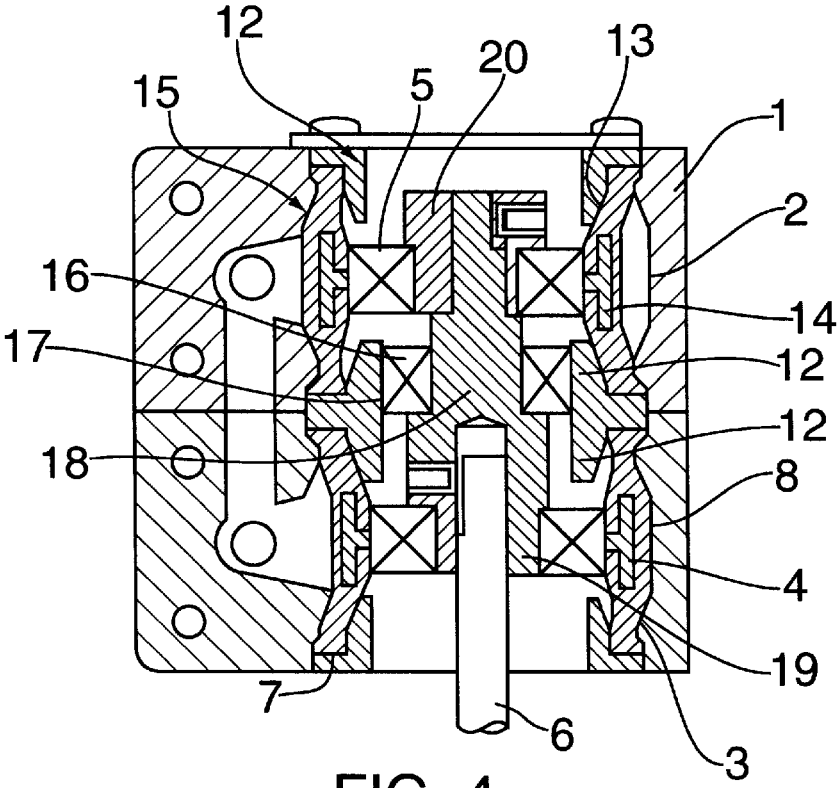
FIG. 4 shows two such pumps mounted in tandem.

FIG. 4 of the drawings shows two such pumps mounted side by side with their respective annular grooves in communication with common inlet and outlet ports. The adjacent annular walls 12 of the two housings are formed integrally as a single component and a bearing 16 is mounted in a seat 17 formed in the walls to support a stub shaft 18 extending through the housings to which motor driven shaft 6 is coupled. Stub shaft 18 has an integral eccentric seat 19 for the bearing 5 of one of the pumps and a separate eccentric seat 20 in the bearing 5 of the other pump. Eccentric seat 20 is arranged to be exactly out of phase with eccentric seat 19 so that the sinusoidal displacement of each pump provides a substantially constant output (and intake).

I claim:

1. A rotary pump having a housing defining an annular chamber extending about a central chamber axis with inlet and outlet ports spaced apart around the chamber, a flexible annular diaphragm forming one side of the chamber spaced opposite an annular wall of the housing, the diaphragm being sealed at an edge thereof to the housing, a partition extending across the chamber from a location between the inlet and outlet ports to the diaphragm, pressing means extending around the diaphragm pressing the diaphragm against the opposite annular wall of the housing to force fluid drawn in at the inlet port around the chamber and to expel the fluid from the chamber at the outlet port, and means to reinforce an axially central region of the diaphragm to hold the region substantially rigid thereby controlling the diaphragm sufficiently to provide a substantially sinusoidal displacement, wherein the reinforcing means for the diaphragm comprises a rigid ring embedded in and movable with the axially central region of the diaphragm and in direct contact with the pressing means to drive the diaphragm through pressure and suction cycles symmetrically, thereby enhancing vacuum performance and smoothness.

2. A rotary pump as claimed in claim 1, wherein the partition between the diaphragm and chamber wall between the inlet and outlet ports comprise a flexible web formed integrally with the diaphragm and sealed at its edges to the housing between said inlet and outlet ports.

3. A rotary pump as claimed in claim 1, wherein a flexible portion of the diaphragm is adapted to provide a controlled internal leak to limit a maximum pressure of the pump to a safe level, and wherein the maximum pressure is determined by a width of the reinforcing ring.

4. A rotary pump as claimed in claim 1, wherein the housing has a plurality of annular abutments encircling inner sides of elastic portions of the diaphragm to limit travel of the diaphragm away from a groove formed in the housing, thereby preventing the diaphragm from bursting under pressure.

5. A rotary pump as claimed in claim 1, wherein the annular diaphragm is of tubular form, the annular chamber being defined between the diaphragm and the wall and the pressing means acting radially on the diaphragm.

6. A rotary pump as claimed in claim 5, wherein the annular wall of the housing encircles the annular diaphragm and the pressing means is located within the diaphragm and presses the diaphragm radially upwardly against the housing wall.

7. A rotary pump as claimed in claim 6, wherein the pressing means comprises a rotor having an eccentric element which engages the central region of the diaphragm.

8. A rotary pump system comprising:

first and second rotary pumps, each of the first and second rotary pumps having:

a housing;

a flexible annular diaphragm spaced opposite an annular wall of the housing to define an annular chamber therebetween with inlet and outlet ports spaced apart from one another and opening into the chamber, the diaphragm being sealed at an edge thereof to the housing;

a partition extending across the chamber from a location between the inlet and outlet ports to the diaphragm;

pressing means extending around the diaphragm pressing the diaphragm against the opposite annular wall of the housing to force fluid drawn in at the inlet port around the chamber and to expel the fluid from the chamber at the outlet port; and means to reinforce an axially central region of the diaphragm to hold the region substantially rigid thereby controlling the diaphragm sufficiently to provide a substantially sinusoidal displacement, wherein the reinforcing means comprises a rigid ring embedded in and movable with the central region of the diaphragm, the rigid ring being in direct contact with the pressing means to drive the diaphragm through pressure and suction cycles symmetrically, thereby enhancing vacuum performance and smoothness;

wherein the pressure and suction cycles of the first and second rotary pumps are substantially sinusoidal and operate exactly out of the phase with one another whereby a combined output of the pumps is substantially constant and free from pulsations.

* * * * *

UNITED STATES PATENT AND TRADEMARK OFFICE

CERTIFICATE OF CORRECTION

PATENT NO. : 5,988,998
APPLICATION NO. : 08/893275
DATED : November 23, 1999
INVENTOR(S) : Brian Howard Glover It is certified that error appears in the above-identified patent and that said Letters Patent is hereby corrected as shown below:

On the Title Page Item [73], please delete "Assignee: Charles Austin Pumps Ltd., Surrey, United Kingdom" and replace with -- Assignee: Charles Austen Pumps Ltd., Surrey, United Kingdom --.

Signed and Sealed this
Seventeenth Day of May, 2011

David J. Kappos

David J. Kappos
*Director of the United States Patent and Trademark Office*